US007503387B2

(12) United States Patent
Edwards

(10) Patent No.: US 7,503,387 B2
(45) Date of Patent: Mar. 17, 2009

(54) METHOD OF LOGGING A WELL EQUIPPED WITH A ROD PUMP

(75) Inventor: John E. Edwards, Medinat Al Alam (OM)

(73) Assignee: Schlumberger Technology Corporation, Sugar Land, TX (US)

( * ) Notice: Subject to any disclaimer, the term of this patent is extended or adjusted under 35 U.S.C. 154(b) by 165 days.

(21) Appl. No.: 11/128,040

(22) Filed: May 12, 2005

(65) Prior Publication Data

US 2006/0225882 A1 Oct. 12, 2006

Related U.S. Application Data

(60) Provisional application No. 60/669,255, filed on Apr. 7, 2005.

(51) Int. Cl.
*E21B 47/00* (2006.01)
*E21B 47/01* (2006.01)

(52) U.S. Cl. ..... 166/254.2; 166/377; 166/385; 166/68; 166/105

(58) Field of Classification Search ..... 166/254.2, 166/377, 385, 68, 105, 242.2
See application file for complete search history.

(56) References Cited

U.S. PATENT DOCUMENTS 2,240,550 A * 5/1941 Conlon, Jr. ..... 166/266
2,885,968 A * 5/1959 Wagner ..... 417/448
3,282,340 A * 11/1966 Park ..... 166/106
4,222,438 A * 9/1980 Hollingsworth et al. ..... 166/264
5,495,547 A * 2/1996 Rafie et al. ..... 385/101
7,201,222 B2 * 4/2007 Kanady et al. ..... 166/68
2005/0150652 A1 * 7/2005 Jackson et al. ..... 166/68.5

OTHER PUBLICATIONS

Mason, D.L. "Production Logging in a Rod-Pumped Well Using Coiled-Tubing-Conveyed Tools and Nitrogen Gas Lift" SPE 22404, Mar. 24, 1992.

* cited by examiner

*Primary Examiner*—Shane Bomar
(74) *Attorney, Agent, or Firm*—Rodney Warfford; David Cate; Jaime Castano

(57) ABSTRACT

In one embodiment, the present invention includes a method of logging a rod-pumped well without removing the production string of tubing (30). The logging is accomplished with a soft-coated cable (100) or a soft-faced sleeve (130) which prevents abrasion or damage to a rod-pump barrel as a logging device or sonde (110) which is lowered into the production string of the rod-pumped well after removal of the sucker rods and the pump assembly without the need to remove the production string. The soft-coated cable or soft-faced sleeve allows logging without damage to the interior surface of the production tubing thereby eliminating scratching or grooving normally associated with previous wireline logging operations.

27 Claims, 2 Drawing Sheets

METHOD OF LOGGING A WELL EQUIPPED WITH A ROD PUMP

CROSS-REFERENCE TO RELATED APPLICATIONS

This application claims the benefit of U.S. patent application Ser. No. 60/669,255 filed Apr. 7, 2005.

BACKGROUND OF INVENTION

The present invention relates to a method of logging a rod-pumped well; more particularly, to a method of logging a rod-pumped well with a resilient-coated cable which provides protection to the interior production tubing to minimize scarring and damage.

Historically, wells completed and requiring artificial lift of the oil from the production zone were rarely logged because of the high cost of removing the rod pump completion, including the production tubing, and replacing both again after logging. New measurement equipment in logging services has become available which makes logging existing wells under rod-pump artificial lift systems more desirable and more easily accomplished. The time required to move a work-over rig on a well site and pull the entire production string before commencing logging has generally made such efforts uneconomic.

Logging of producing wells permits adjustment of production rates, reservoir studies, and other useful information to be gathered to maximize recovery from the well and the surrounding reservoir.

In oil wells requiring artificial lift means, one of the primary means is the rod pump where a subsurface pump and the production tubing work together to lift the oil from the well bore. One configuration is the stationary barrel pump in which the barrel remains fixed while a plunger moves inside it. As the sucker rods pull the plunger up, the hydrostatic head of the tubing fluid pushes a traveling valve (a ball and seat valve) closed and opens a standing valve. As the plunger continues upward, the pressure between the valves is low, and bottom hole pressure opens the standing valve and pushes liquid into the barrel. As the rods begin to move downward, the standing valve closes immediately. With continued downward movement, the pressure between the valves increases until this pressure exceeds the tubing hydrostatic head and opens the traveling valve, allowing liquid between the valves to move above the traveling valve. This portion of liquid is lifted as the next upstroke begins.

Another subsurface pump is the traveling barrel pump. The operation of this pump is similar to the operation of the stationary barrel pump except that the traveling valve is attached to the barrel. The pump may be a complete unit which is attached to the rod string. The pump is lowered into the tubing and attached to a seating nipple by plastic, fiber, or mechanical cups called hold-downs. In some types of rod-pumping systems, one of the bottom tubing joints is the pump barrel. The standing valve, attached to the traveling valve for installation and detached for operation, is lowered and mounted in the seating nipple. Such pump is called a tubing pump.

Irrespective of the type of pump deployed, the hold-down may be located and locked into a seating nipple on the production tubing either above the pump or below the pump. In deep wells, for example, a hold-down at the bottom of the insert pump experiences the hydrostatic head of tubing liquid on both the outside and inside of the barrel and a thin-walled barrel is acceptable. However, solids pumped with the liquids will settle around the pump and possibly wedge it in the tubing. On the other hand, a top-down pump can be used to wash away solids continuously, but a much heavier barrel is required to contain the great difference in pressure between inside and outside without bursting. A compromise is the use of both top and bottom hold-downs, which combine the advantage of both but these require special seating-nipple arrangements.

The selection of tubing is critical for an operator of such wells since during operation the weight of the tubing liquid is transferred from the rod string to the tubing and back. The weight of the tubing liquid is several thousand pounds and the transfer of this much liquid can make the tubing string stretch several feet and rebound on each stroke. This stretching action stresses the tubing and can cause tubing failure. Operators are therefore very wary of allowing anything to be used on the interior surface of the tubing string that may accelerate the fatigue/failure cycle. Further, the integrity of the pump body and the seats requires any service work performed avoid damage to the interior surface of the pump body.

A through-tubing logging method has long been needed for a rod-pumped well system. The present invention permits well logging in a fraction of the time necessary using prior methods thereby saving substantial expense for rig and crew time.

SUMMARY OF INVENTION

The present invention relates to a method of logging a rod-pumped well comprising the steps of removing a plurality of sucker rods, a plunger and a standing valve from a production string of tubing of a rod-pumped well, deploying a cable with a logging device in the production string of tubing and into the barrel of the rod-pump; and, logging the rod-pumped well. The method can also include the steps of inserting a plurality of sucker rods, a plunger and a standing valve in the well after logging; and seating the rod-pump in a seating nipple in a distal end of the production string of tubing to re-establish the pumping of the well. The cable is preferably a soft-coated cable 100 , such as that shown in FIG. 5. The soft-coated cable 100 avoids damage to the interior surface of the production tubing and pump barrel thereby minimizing the possibility of accelerating corrosion or failure of the tubing. In one embodiment, this soft-coated cable 100 is a metallic conductor 102, protected within an armor wire support, both embedded within a polymeric material 104 extending to form a jacket around the outer layer of the metallic conductor/armor wire cable 102. In other embodiments , the metallic conductor 102 can be replaced with a plurality of metallic conductors, a fiber optic cable, or a plurality of fiber optic cables without departing from the method disclosed herein.

The soft-coating utilized in the present invention is a polymeric material disposed in the interstitial spaces of the armor wire and the insulated conductor or conductors. The polymeric material can be selected from the group consisting of polyolefins, polyaryletherether ketones, polyaryl ether ketones, polyphenylene sulfides, polymers of ethylene-tetrafluroethylene, polymers of poly(1,4-phenylene), polytetrafluoroethylenes, perfluoroalkoxy polymers, fluorinated ethylene-propylene copolymers, perfluoromethoxy polymers, and any mixtures thereof, and may further include wear resistance particles or even short fibers.

Further examples of the materials and method of making the logging cable are more fully described in U.S. patent application Ser. No. 11/033698, filed Jan. 12, 2005, entitled "Enhanced Electrical Cables", which is expressly incorporated herein for all purposes and made a part hereof.

The soft-coated cable provides a conductor embedded in a polymeric matrix such that the exterior surface of the cable yields to the pressure rather than abrading the interior surface of the production tubing when contacting the interior surface of the tubing. This method permits the steps, after removing only the rod string and rod pump including the standing valve, of inserting a sonde, or a long pipe-shaped device containing logging sensors or actuators, having a radial diameter smaller than an interior radial diameter of the tubing on a soft-coated cable, into the longitudinal passage formed in the interior of the production tubing, and lowering the sonde and cable into the well bore; energizing the sonde from a surface control system; and, removing the sonde and cable from the well bore after completion of the logging. The sonde can also be sized to permit it to be inserted through a standing-valve seating nipple into the production zone.

In an alternative embodiment, a soft-sleeve is deployed around the lower or distal end of the cable to prevent damage to the rod-pump barrel. This permits logging of the rod-pumped well wherein at least a portion of the cable is enclosed by a soft-faced sleeve and the logging step is completed with the cable and soft-coated sleeve. The soft-faced sleeve may be formed around the cable or may be a substantially hollow cylinder which is attached to the cable prior to deployment. The outer diameter of this soft-faced sleeve is less than the inner diameter of the pump barrel and can provide an outer diameter substantially larger than the diameter of the cable. The inner diameter of the soft-face sleeve is substantially equal to the outer diameter of the cable but can provide enough resilience to fit snugly around the cable. The soft-faced sleeve can provide a longitudinal groove to allow the cable to be inserted into the sleeve. As with the soft-coated cable, the cable can be formed of one or more metallic conductors or may provide one or more fiber optic cables surround by the sleeve.

Finally, the method of the present invention can be practiced by using both the soft-coated cabling described herein together with the sleeve arrangement for at least a portion of the cable.

DETAILED DESCRIPTION OF THE INVENTION

Figure 1:
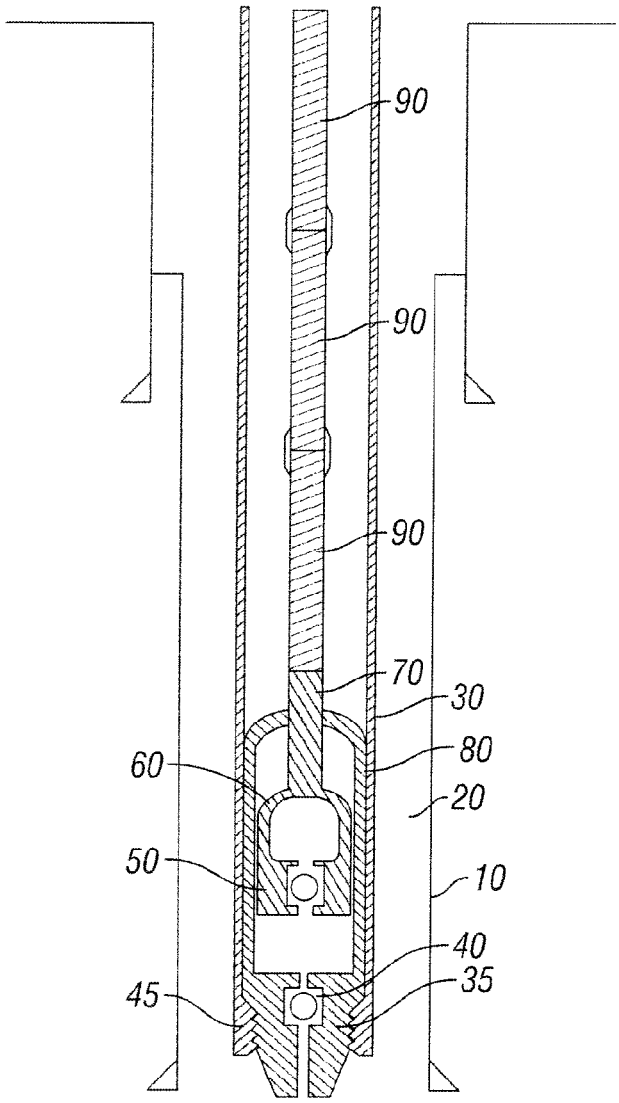
FIG. 1 is a schematic cross-sectional drawing of a rod pump deployed in a well bore.

As more fully described in FIG. 1, wells produced with rod pumps are arranged so that a plurality of sucker rods 90 attached to a pull rod 70 that is connected in a barrel 80 to a traveling valve 60, provide a traveling valve cage or plunger 50 for a ball valve arrangement. The traveling valve 60 moves within the barrel 80 which is retained by hold-down 35 at the end of the tubing 30 in a seating nipple 45. Barrel 80 also provides a standing valve 40, providing a ball valve arrangement to selectively permit entry of well liquids into the space on the interior portion of the barrel 80. As previously noted however, hold down 35 and seating nipple 45 may be located either at the lower or distal end of the production tubing 30 within the casing 10 and annulus 20 or may be located above the traveling valve 50. The primary purpose of the hold down and seating nipple is to fix the barrel 80 to the interior portion of the production tubing to allow relative movement of the traveling valve 50 inside the barrel 80.

Other forms of pumps called traveling barrel pumps fix the traveling valve to the barrel and permit movement of the barrel around a plunger which is set in the hold down to fix the standing valve in the production tubing.

Figure 2:
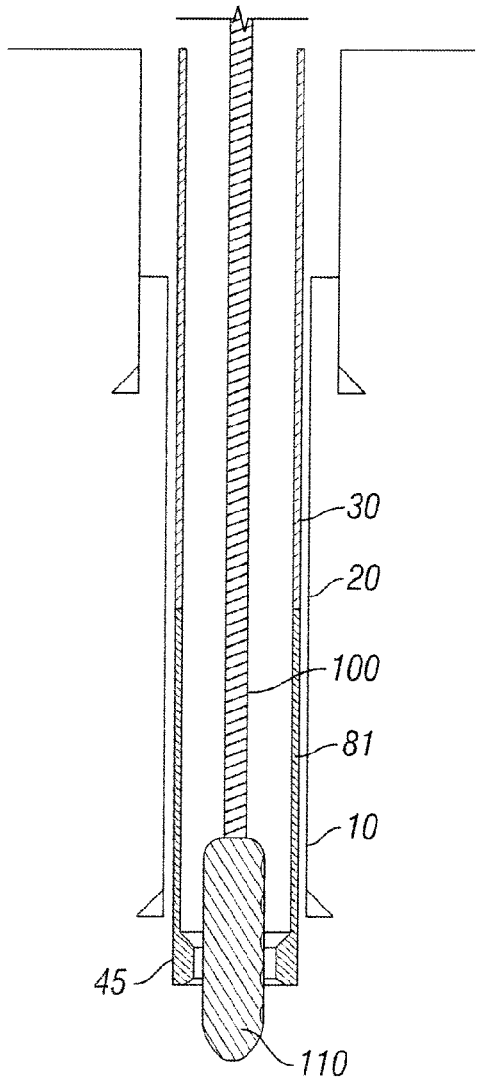
FIG. 2 is a schematic drawing of a sonde on a coated cable deployed in a well bore after removal of the rod pump from a hold down nipple.

In the present invention, the rod pump and rods are removed from the well bore using conventional methods. As shown in FIG. 2, the production tubing 30 and another embodiment of a rod-pump barrel 81 need not be removed before logging sonde 110 on coated cable 100 is lowered by conventional means into the well bore from the surface. Since the sonde 110 is smaller than the inner diameter of the landing nipple 45 and the cable 100 is smaller than the outer diameter of sonde 110, the whole assembly can be moved past the landing nipple 45 into the production zone of the well. Once the logging is completed, the rod pump and rods are reinserted into the production tubing 30 and seated in the seating nipple 45 with hold-down 35, and pumping operations can be resumed. The ability to log the well without pulling the production tubing allows the whole process to be accomplished in approximately half the time of previous logging methods.

Figure 3:
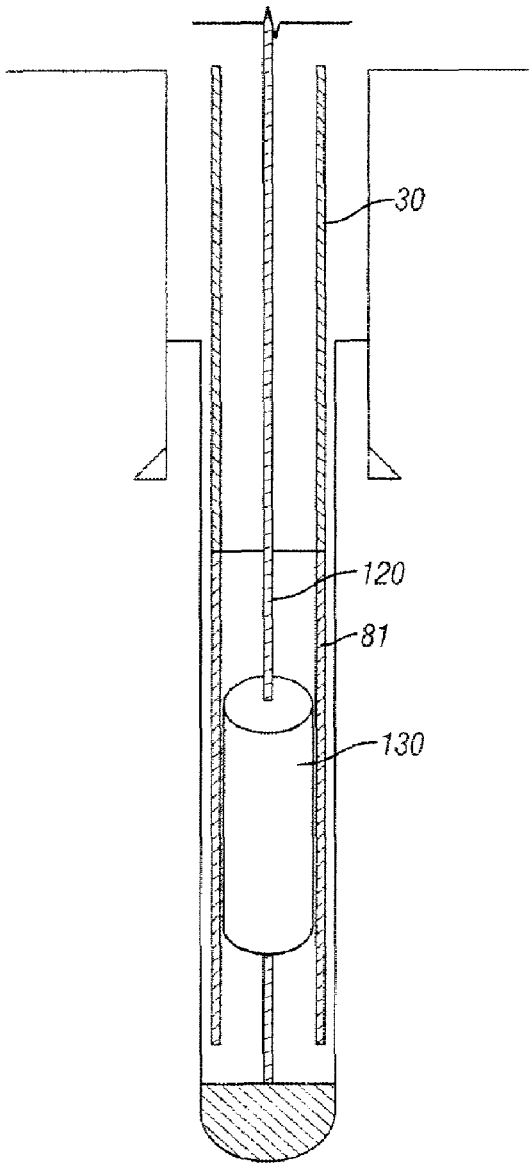
FIG. 3 is a schematic drawing of a cable with a protective sleeve engaged with a cable deployed in a well bore.

In another embodiment of the present invention, the coated cable can be replaced with a conventional cable 120 and a soft-faced protective sleeve 130. As shown in FIG. 3, a soft-faced protective sleeve 130 can be placed around the conventional cable 120 before lowering a sonde 110 into the well bore 30 via conventional means. The soft-faced sleeve 130 has no size requirements, but is preferably substantially a hollow elastomeric cylinder and covers only a portion of the conventional cable 120 at its distal end. The soft-faced protective sleeve 130 preferably has an outer diameter approximately equal to the sonde 110. While a diameter approximately equal to the sonde is preferred, any outer diameter smaller than the inner diameter of the well bore 30 and seating nipple 45 but larger than the outer diameter of the cable 120 can be used. The inner material of the soft-faced sleeve can be constructed of any material that will not damage the cable and which may be affixed over the cable. The outer facing of the soft-faced sleeve can be constructed from any material that will not cause additional wear on the well bore 30, but is preferably constructed out of materials similar to the materials used for coating the coated cable 100.

As the sonde 110 descends into the well bore, the soft-faced protective sleeve 130 protects the well bore 30 from contact with the conventional cable 120. As the sonde 110 further descends into the well bore 30, the protective sleeve 130 also inhibits damage to the seating nipple 45.

Figure 4:
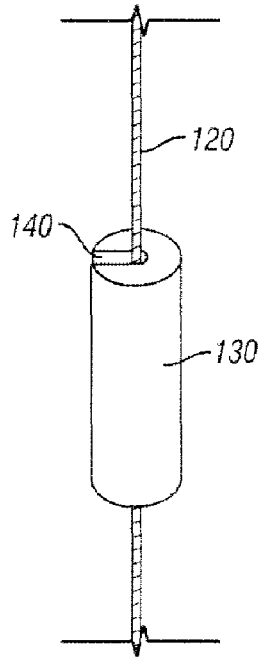
FIG. 4 is a schematic drawing of a cable having a protective sleeve with vertical groove.
Figure 2A:
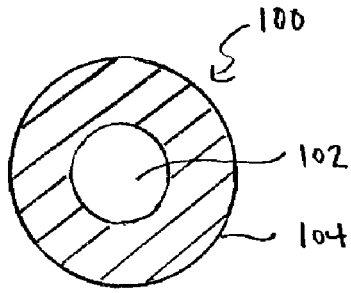
FIG. 2A is a schematic drawing of a cross section of the coated cable of *Fig*. 2.

In the alternative embodiment of the soft-faced sleeve 130 as more fully shown in FIG. 4, the soft-faced sleeve 130 has a groove 140 along the longitudinal axis of the cylinder to facilitate easy installation of the soft-faced protective sleeve 130 on cable 120. While there are no depth requirements for the groove 140, the groove 140 should be chosen such that the cable 120 will be centrally located in the soft-faced sleeve 130 when installed to provide maximum protection for the well bore 30. Other means of affixing the sleeve to the cable can be readily substituted for the present groove without departing from the spirit or intent of this invention.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A method of logging a rod-pumped well comprising the steps of:

inserting a plurality of sucker rods, a plunger, a barrel and a standing valve into a production string of tubing to form a rod pump;

operating the rod pump to extract fluids from the well and into the production string of tubing;

removing the plurality of sucker rods, the plunger, the barrel and the standing valve from the production string of tubing;

deploying a cable, having a logging sensor attached thereto into said production string of tubing, wherein said deploying is performed after said removing; and, operating the logging sensor to log the well.

2. The method of claim 1 further comprising the steps of:

removing the logging sensor from the production string of tubing;

re-inserting the plurality of sucker rods, the plunger, the barrel and the standing valve into the production string of tubing to form the rod pump, after the removing of the logging sensor; and re-operating the rod pump to extract fluids from the well and into the production string of tubing.

3. The method of claim 1 wherein the cable is soft-coated and the logging step is completed with the soft-coated cable.

4. The method of claim 3 wherein at least a portion of the cable is enclosed by a soft-faced sleeve and the logging step is completed with the cable and soft-coated sleeve.

5. The method of claim 3 wherein the soft-coated cable comprises a metallic conductor covered with a polymeric material extending to form a jacket around the outer layer of the matallic conductor.

6. The method of claim 3 wherein the soft-coated cable comprises a metallic conductor in a resilient matrix.

7. The method of claim 3 wherein the soft-coated cable comprises a fiber optic conductor covered with a polymeric material extending to form a jacket around the outer layer of the conductor.

8. The method of claim 3 wherein the soft-coated cable comprises a fiber optic conductor in a resilient matrix.

9. The method of claim 1 wherein at least a portion of the cable is enclosed by a soft-faced sleeve and the logging step is completed with the cable and soft-coated sleeve.

10. The method of claim 9 wherein the soft-faced sleeve is substantially a hollow cylinder.

11. The method of claim 10 wherein the outer diameter of the soft-face sleeve is less than the inner diameter of the pump barrel.

12. The method of claim 10 wherein the outer diameter of the soft-face sleeve is substantially larger than the diameter of the cable.

13. The method of claim 10 wherein the inner diameter of the soft-face sleeve is substantially equal to the outer diameter of the cable.

14. The method of claim 10 wherein the soft-faced sleeve further comprises a groove.

15. The method of claim 9 wherein the cable comprises a matallic conductor.

16. The method of claim 9 wherein the cable comprises a fiber optic cable.

17. The method of claim 1, wherein the production tubing is disposed within a casing of the well.

18. A method of logging a rod-pumped well comprising the steps of:

inserting a plurality of sucker rods, a plunger, a barrel and a standing valve into a production string of tubing to form a rod pump;

connecting the rod pump to a seating nipple in the production string of tubing;

operating the rod pump to extract fluids from the well;

disconnecting the rod pump from the seating nipple;

removing the plurality of sucker rods, the plunger and the standing valve from the production string of tubing;

inserting a logging sonde into the production string of tubing and lowering the logging sonde past the seating nipple;

energizing the logging sonde from a surface control system to log the well; and, removing the logging sonde from the well bore.

19. The method of claim 18 wherein the logging sonde is connected to a soft-coated cable.

20. The method of claim 18 comprising the further step of reinserting a plurality of sucker rods, a plunger and a standing valve in the production string of tubing.

21. The method of claim 18, wherein the production tubing is disposed within a casing of the well.

22. A method of using a soft-coated cable in a well bore containing a tubing pump comprising the steps of:

manipulating a plunger to attach to a standing valve assembly;

removing a plurality of sucker rods, the plunger and the standing valve from a production string of tubing providing a longitudinal passage;

inserting a sonde on the cable into the longitudinal passage and lowering the sonde and cable into the well bore through the longitudinal passage in the production tubing, wherein the sonde has a radial diameter smaller than an interior radial diameter of the tubing;

energizing the sonde from a surface control system to log the well; and, removing the sonde and cable from the well bore.

23. The method of claim 22 wherein the sonde is inserted through a standing-valve seating nipple.

24. The method of claim 22 comprising the further steps, after logging, of reinserting a plurality of sucker rods, a plunger and a standing valve in the production string of tubing and manipulating the plunger to seat the standing valve in a seating nipple.

25. The method of claim 22, wherein the production tubing is disposed within a casing of the well.

26. A method of logging a rod-pumped well comprising the steps of:

inserting a production string of tubing into a casing in the well, wherein the production string of tubing includes a rod pump;

operating the rod pump to extract fluids from the well;

removing a plurality of sucker rods from the rod pump and from said production string of tubing;

thereafter deploying a cable with a logging sensor in said production string of tubing; and logging the well.

27. The method of claim 26, wherein the removing further comprises removing a plunger, a barrel and a standing valve from the rod pump.

* * * * *